US009490598B2

(12) United States Patent
Onoda et al.

(10) Patent No.: US 9,490,598 B2
(45) Date of Patent: Nov. 8, 2016

(54) TERMINAL CONNECTING STRUCTURE

(71) Applicant: YAZAKI CORPORATION, Tokyo (JP)

(72) Inventors: Shinya Onoda, Shizuoka (JP); Motofumi Kato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/652,524

(22) PCT Filed: Jan. 10, 2014

(86) PCT No.: PCT/JP2014/050374

§ 371 (c)(1),
(2) Date: Jun. 16, 2015

(87) PCT Pub. No.: WO2014/109404

PCT Pub. Date: Jul. 17, 2014

(65) Prior Publication Data

US 2015/0333462 A1 Nov. 19, 2015

(30) Foreign Application Priority Data

Jan. 11, 2013 (JP) ..... 2013-003373

(51) Int. Cl.
*H01R 25/16* (2006.01)
*H01R 4/48* (2006.01)
(Continued)

(52) U.S. Cl.
CPC ..... *H01R 25/162* (2013.01); *H01R 4/48* (2013.01); *H01R 11/12* (2013.01); *H01R 13/20* (2013.01); *H01R 2201/26* (2013.01)

(58) Field of Classification Search
CPC ..... H01R 4/48; H01R 11/12; H01R 25/162; H01R 13/20; H01R 2201/26
USPC ..... 439/121, 345, 98–99, 550, 555, 559, 439/562–564, 573, 95, 424, 465, 877
See application file for complete search history.

(56) References Cited

U.S. PATENT DOCUMENTS 6,991,493 B2 * 1/2006 Matsui ..... H01R 4/66 439/579
7,476,129 B2 * 1/2009 Droesbeke ..... H01R 9/0527 439/607.41
(Continued)

FOREIGN PATENT DOCUMENTS

CN 102082332 A 6/2011
CN 102377047 A 3/2012
(Continued)

OTHER PUBLICATIONS

English language Written Opinion of the International Search Report for PCT/JP2014/050374 dated Apr. 15, 2014.
(Continued)

*Primary Examiner* — Edwin A. Leon
(74) *Attorney, Agent, or Firm* — Kenealy Vaidya LLP

(57) ABSTRACT

A terminal connection portion of a bus bar includes a first locking portion and a second locking portion. An electric connection plate portion of a connecting terminal, a rear end portion of which is fixed to an end portion of an electric wire, is curved and convex in a direction facing the terminal connection portion, and a first engaging portion formed at a distal end portion is locked by the first locking portion. A second engaging portion formed on a wire fixing side is locked by the second locking portion in a state in which the electric connection plate portion is pressed on the terminal connection portion.

4 Claims, 5 Drawing Sheets

(51) Int. Cl.
*H01R 11/12* (2006.01)
*H01R 13/20* (2006.01)

(56) References Cited

U.S. PATENT DOCUMENTS

| | | | |
|---|---|---|---|
| 2011/0104961 | A1 | 5/2011 | Kim et al. |
| 2012/0034826 | A1 | 2/2012 | Ishikawa et al. |
| 2013/0122731 | A1 | 5/2013 | Deno et al. |

FOREIGN PATENT DOCUMENTS

| | | | |
|---|---|---|---|
| JP | 2-46376 | U | 3/1990 |
| JP | 2-213063 | A | 8/1990 |
| JP | 2008-52929 | A | 3/2008 |
| JP | 4686649 | B1 | 5/2011 |
| JP | 2011-141191 | A | 7/2011 |
| JP | 2012-29512 | A | 2/2012 |

OTHER PUBLICATIONS

International Search Report for PCT/JP2014/050374 dated Apr. 15, 2014.

Japanese Office Action for the related Japanese Patent Application No. 2013-003373 dated Jun. 14, 2016.

Japanese Office Action for the related Japanese Patent Application No. 2013-003373 dated Aug. 16, 2016.

Chinese Office Action for the related Chinese Patent Application No. 201480004551.3 dated Aug. 1, 2016.

* cited by examiner

TERMINAL CONNECTING STRUCTURE

TECHNICAL FIELD

The present invention relates to a terminal connecting structure.

BACKGROUND ART

According to a known terminal connecting structure in a current detector mounted on a passenger vehicle, a cargo truck or the like to detect charging or discharging current of a battery, or in a fuse unit directly attached to a battery post via a battery terminal, a bolt is passed through a circular mounting hole formed through a bus bar (a metal plate), and an LA terminal (a connecting terminal) of a cable, and is tightened by a nut, whereby the cable is detachably attached to the bus bar (see Patent Document 1). As shown in FIG. 5, in a terminal connecting structure used in a current detector 501, terminal connection portions 507 of bus bars 505 which are insert molded with a device housing 503 are disposed such that the front and rear surfaces thereof are exposed. Bus bar holes 509 are opened in the terminal connection portions 507. An LA terminal 515 in which a terminal hole 513 is disposed is crimped on the end of a cable 511. The LA terminal 515 is electrically connected to the terminal connection portion 507 of the bus bar 505 in a state in which the contact pressure is provided, by inserting the shaft 519 of a bolt 517 passing through the terminal hole 513, into the bus bar hole 509, and then tightening a nut 521.

That is, in a tightening work in the terminal connecting structure using the bolt 517 and the nut 521, the LA terminal 515 is set (placed) on a terminal mounting surface of the bus bar 505, and the position of the terminal hole is aligned with the bus bar hole. Next, to prevent skew tightening from occurring, the bolt 517 is temporarily tightened. Thereafter, the bolt 517 is fully tightened. Finally, looseness of the bolt 517 is checked.

PRIOR ART DOCUMENT

Patent Document

Patent Document 1: JP 2011-141191 A

SUMMARY OF INVENTION

Problem to be Solved by Invention

In the conventional terminal connecting structure described above, however, the contact pressure between the bus bar 505 and the LA terminal 515 is provided by using the bolt 517 and the nut 521, and therefore a connection failure may occur due to a thread tightening failure (skew tightening, or breakage of screw threads due to over tightening) or the like. Moreover, at least two components functioning as tightening members, i.e., the bolt 517 and the nut 521 are necessary (a washer, a spring washer, a tooth lock washer, or the like may be additionally required as a locking member). Therefore, the number of components and the total weight of components are increased. In a tightening work in the terminal connecting structure using the bolt 517 and the nut 521, furthermore, temporal tightening, full tightening, and a checking work are necessary. In the tightening work in temporal tightening, the position of the hole of the LA terminal 515 needs to be aligned with the bus bar 505. In addition, to perform tightening at a predetermined tightening torque, a torque wrench may be necessary, and when a connecting work is to be conduced in a plurality of places, the work is cumbersome.

The present invention has been made in view of the circumstances described above, and it is an object thereof to provide a terminal connecting structure in which a connection failure is less likely to occur, and the number of components and working man-hours can be reduced.

Means for Solving the Problem

The object of the present invention is achieved by the following configuration.

(1) A terminal connecting structure including a terminal connection portion of a metal plate, the terminal connection portion having a first locking portion and a second locking portion, an electric connection plate portion of a connecting terminal, a rear end portion of which is fixed to an end portion of an electric wire, the electric connection plate portion being curved and convex in a direction facing the terminal connection portion, the electric connection plate portion having a first engaging portion formed at a distal end portion of the electric connection plate portion and locked by the first locking portion and a second engaging portion formed on a side where the electric wire is fixed, the second engaging portion being locked by the second locking portion in a state in which the electric connection plate portion is pressed on the terminal connection portion.

According to the terminal connecting structure having the configuration of (1) described above, in a state in which the first engaging portion of the connecting terminal is locked by the first locking portion of the terminal connection portion, the second engaging portion of the connecting terminal is locked by the second locking portion of the terminal connection portion while pressing the curved electric connection plate portion against the terminal connection portion such that the electric connection plate portion is elastically deformed. Then, the connecting terminal having the first engaging portion and the second engaging portion both locked and fixed to the terminal connection portion is held in a state in which the electric connection plate portion curved and convex toward the terminal connection portion is strongly pressed on the terminal connection portion due to the elastic restoring force, so that high contact load is provided on the metal plate. In this way, the connecting terminal is reliably connected and fixed to the terminal connection portion without using a bolt and a nut. The connecting terminal itself, the rear end of which being fixed to the end portion of the electric wire, has the fixing structure (the first engaging portion and the second engaging portion), and is directly fixed to the metal plate having the locking structure (the first locking portion and the second locking portion). Therefore, additional fastening means is not required. The fixing structure and the locking structure can be formed simply by pressing the connecting terminal and the metal plate.

(2) The terminal connecting structure having the configuration of (1) described above, in which the first locking portion includes a pair of slit openings provided in the terminal connection portion side by side in a front-rear direction of the connecting terminal, the second locking portion has a hook-shaped cut-and-raised projection configured such that the terminal connection portion is cut and raised and having a folded back distal end, the first engaging portion is configured as a hook passing through the pair of slit openings and having a U-shaped cross section, and the second engaging portion has an engagement opening in which the cut-and-raised projection of the second locking portion is inserted such that the folded back distal end is butted against an upper surface of the second engaging portion defining an opening edge.

According to the terminal connecting structure having the configuration of (2) described above, the first engaging portion of in the connecting terminal configured as a hook having a U-shaped cross section is inserted into one of the pair of slit openings of the first locking portion to a back side and is projected from the back side of metal plate to the surface side of the metal plate through the other slit opening. Accordingly, the first engaging portion is reliably locked by the first locking portion in a direction in which the first engaging portion does not separate from the surface of the metal plate. The second engaging portion having the engagement opening of the connecting terminal is fitted onto the cut-and-raised second locking portion having the hooked distal end, whereby the second locking portion which has been once elastically deformed is elastically restored to be locked by the upper surface defining the opening edge of the engagement opening. The folded back distal end of the second locking portion is strongly butted against the upper surface defining the opening edge due to the elastic restoring force of the electric connection plate portion that is being pressed, so that the locking by the engagement opening is difficult to be released.

In the foregoing, the present invention has been briefly described. Details of the present invention will be further clarified by reading through a mode for carrying out the invention (hereinafter, "embodiment") which will be described below with reference to the accompanying drawings.

EMBODIMENTS OF INVENTION

Figure 1:
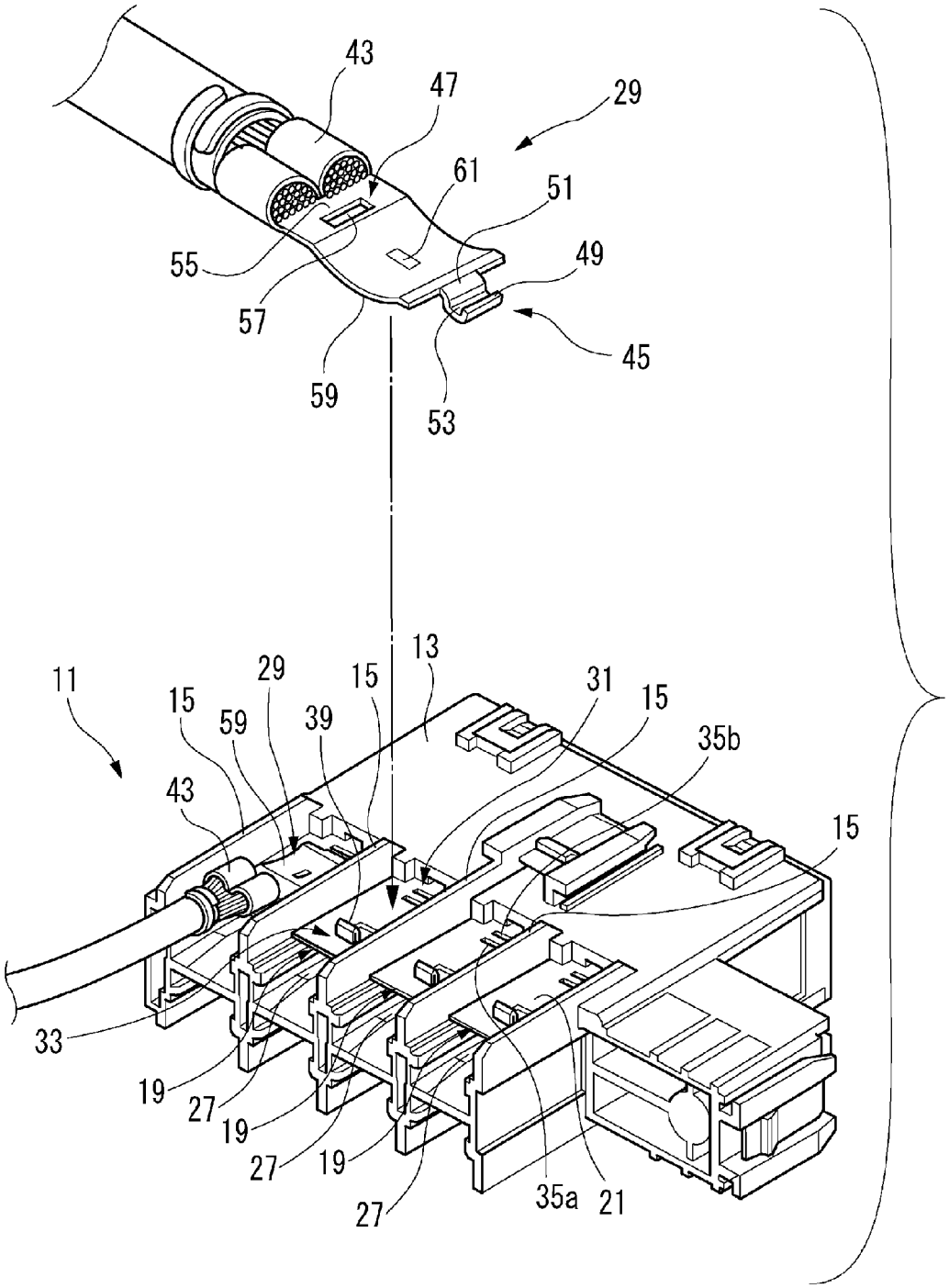
FIG. 1 is a perspective view of a current detector including a terminal connecting structure according to an embodiment of the present invention.
Figure 2:
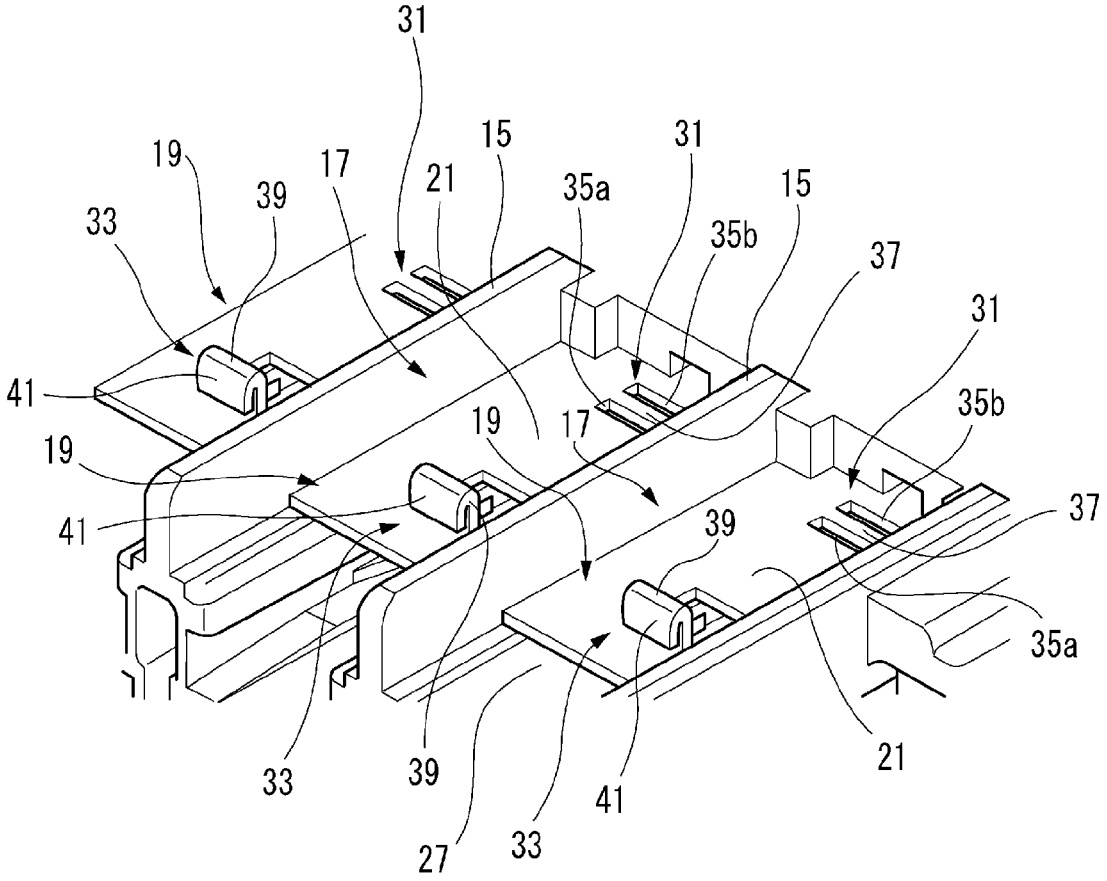
FIG. 2 is an enlarged view of main parts of the terminal connection portion in a housing shown in FIG. 1.

Hereinafter, an embodiment of the invention will be described with reference to the drawings. As shown in FIGS. 1 and 2, a terminal connecting structure according to the embodiment of the invention may be used in a current detector 11 for detecting the charging or discharging current of, for example, a vehicle battery. The current detector 11 has a housing 13 made of an insulating resin. In each of the upper and lower sides of the housing 13, four bus bar exposed portions 17 separated from each other by a plurality of partition walls 15 are formed, and in each of the bus bar exposed portions 17, a terminal connection portion 21 of a bus bar (metal plate) 19 to be connected to a not-shown current detecting circuit is exposed (see FIG. 2). The bus bar 19 is formed by press molding an electrically conductive metal plate, and the terminal connection portion 21 is formed into a substantially rectangular shape. In the bus bar 19, an alloy material (for example, phosphor bronze) which exhibits high conductivity and has a spring property is preferably used.

A space 27 (see FIG. 3) is provided on the side of the lower surface of the terminal connection portion 21 which is insert-molded in the housing 13, and which is exposed to the bus bar exposed portion 17. A connecting terminal 29 provided with an electric connection plate portion 59 which has a substantially rectangular plate-like shape is attached to the terminal connection portion 21. A part of the space 27 is used in attachment of the connecting terminal 29.

The terminal connection portion 21 of the bus bar 19 includes a first locking portion 31 and a second locking portion 33. The first locking portion 31 is formed in the exposed base end side (in FIG. 2, the right side) of the terminal connection portion 21. The first locking portion 31 is configured as a pair of slit openings 35*a*, 35*b* provided in the terminal connection portion 21 side by side in the front-rear direction of the connecting terminal 29 to be connected and fixed to the terminal connection portion 21. The slit openings 35*a*, 35*b* are elongated in the lateral width direction of the connecting terminal 29 to be connected and fixed, and are provided parallel to each other and separated from each other in the front-rear direction of the connecting terminal 29. Therefore, the portion between the pair of slit openings 35*a*, 35*b* is formed as a beam portion 37. The space below the slit openings 35*a*, 35*b* and the beam portion 37 is at least a part of the space 27.

The second locking portion 33 is formed in the exposed distal end side (in FIG. 2, the left side) of the terminal connection portion 21. The second locking portion 33 has a hook-shaped cut-and-raised projection 39 configured such that the terminal connection portion 21 is cut and raised and having a folded back distal end (see FIG. 3). In the embodiment, a cut-and-raised hook 41 having a hook shape is folded back toward the exposed distal end side of the terminal connection portion 21. A gap is provided between the distal end of the cut-and-raised hook 41 and the surface of the terminal connection portion 21. The gap is ensured to be larger than at least the thickness of the connecting terminal 29.

Although, in the embodiment, the cut-and-raised hook 41 is folded back toward the exposed distal end side of the terminal connection portion 21, the cut-and-raised hook 41 may be folded back toward the exposed base end side of the terminal connection portion 21. Alternatively, the cut-and-raised hook 41 may be configured such that it is divided into two in the width direction of the terminal connection portion 21, one of the divided hook being folded back toward the exposed distal end side of the terminal connection portion 21, and the other divided hook being folded back toward the exposed base end side of the terminal connection portion 21.

On the other hand, the connecting terminal 29 to be attached to the terminal connection portion 21 of the bus bar 19 is formed by press molding a plate member. Also in the connecting terminal 29, an alloy material (for example, phosphor bronze) which exhibits high conductivity and has a spring property is preferably used. The connecting terminal 29 is formed with a conductor crimp portion 43 at its rear end portion, and is fixed to an end portion of an electric wire by the conductor crimp portion 43. An electric connection plate portion 59 of the connecting terminal 29, the rear end portion of which is fixed to the end portion of the electric wire, is curved and convex in a direction facing the terminal connection portion 21. A first engaging portion 45 is formed in a distal end portion of the electric connection plate portion 59, and a second engaging portion 47 is formed on a side where the electric wire is fixed. In the convex surface side of the electric connection plate portion 59, an indent 61 for enhancing the electrical conductivity between the portion and the terminal connection portion 21 may be projected.

The first engaging portion 45 in the embodiment is configured as a hook shape to be passed through the pair of slit openings 35*a*, 35*b* of the terminal connection portion 21 and has a U-shaped cross section. The hook-shaped first engaging portion 45 has an engagement recess 53 between a terminal hook 49 on the distal end side and a basal end bent portion 51. The beam portion 37 between the slit openings 35*a*, 35*b* is fitted into the engagement recess 53 (see FIG. 3). The second engaging portion 47 in the embodiment is formed on the side where the electric wire is fixed, close to the conductor crimp portion 43. The second engaging portion 47 has a rectangular engagement opening 57 in which the cut-and-raised projection 39 of the second locking portion 33 is inserted such that the folded back distal end (the cut-and-raised hook 41) is butted against the upper surface 55 defining the opening edge.

Then, the first engaging portion 45 (the terminal hook 49) of the connecting terminal 29 is locked by the first locking portion 31 (the slit openings 35*a*, 35*b*), and the second engaging portion 47 (the engagement opening 57) is locked by the second locking portion 33 (the cut-and-raised hook 41) in a state in which the electric connection plate portion 59 is pressed on the terminal connection portion 21.

Figure 3:
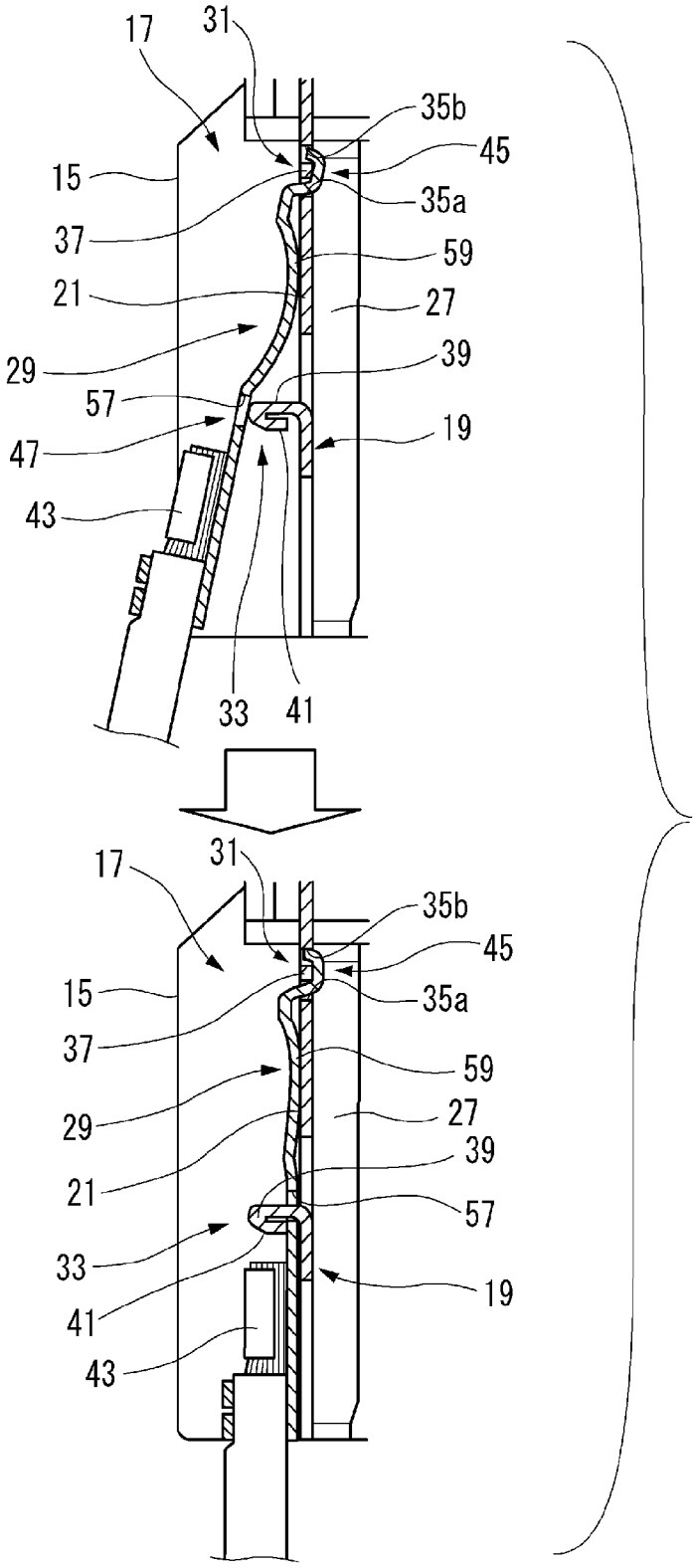
FIG. 3 is a sectional view of main parts, illustrating a procedure for attaching a connecting terminal to the terminal connection portion shown in FIG. 2.

Next, the function of the terminal connecting structure having the configuration described above will be described. In the terminal connecting structure of the embodiment, as shown in FIG. 3, in a state in which the first engaging portion 45 of the connecting terminal 29 is locked by the first locking portion 31 of the terminal connection portion 21, the second engaging portion 47 of the connecting terminal 29 is locked by the second locking portion 33 of the terminal connection portion 21 while pressing the curved electric connection plate portion 59 against the terminal connection portion 21 such that the electric connection plate portion 59 is elastically deformed.

Figure 4:
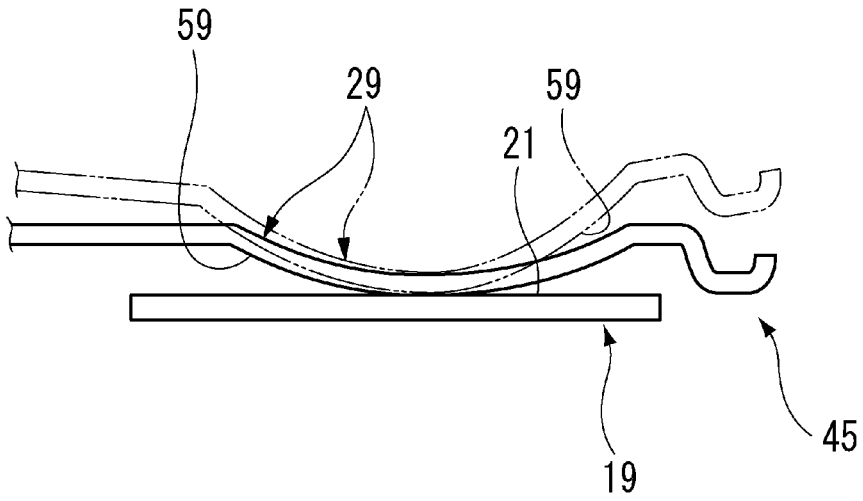
FIG. 4 is a diagram illustrating a deformation of an electric connection plate portion of the connecting terminal shown in FIG. 3.
Figure 5:
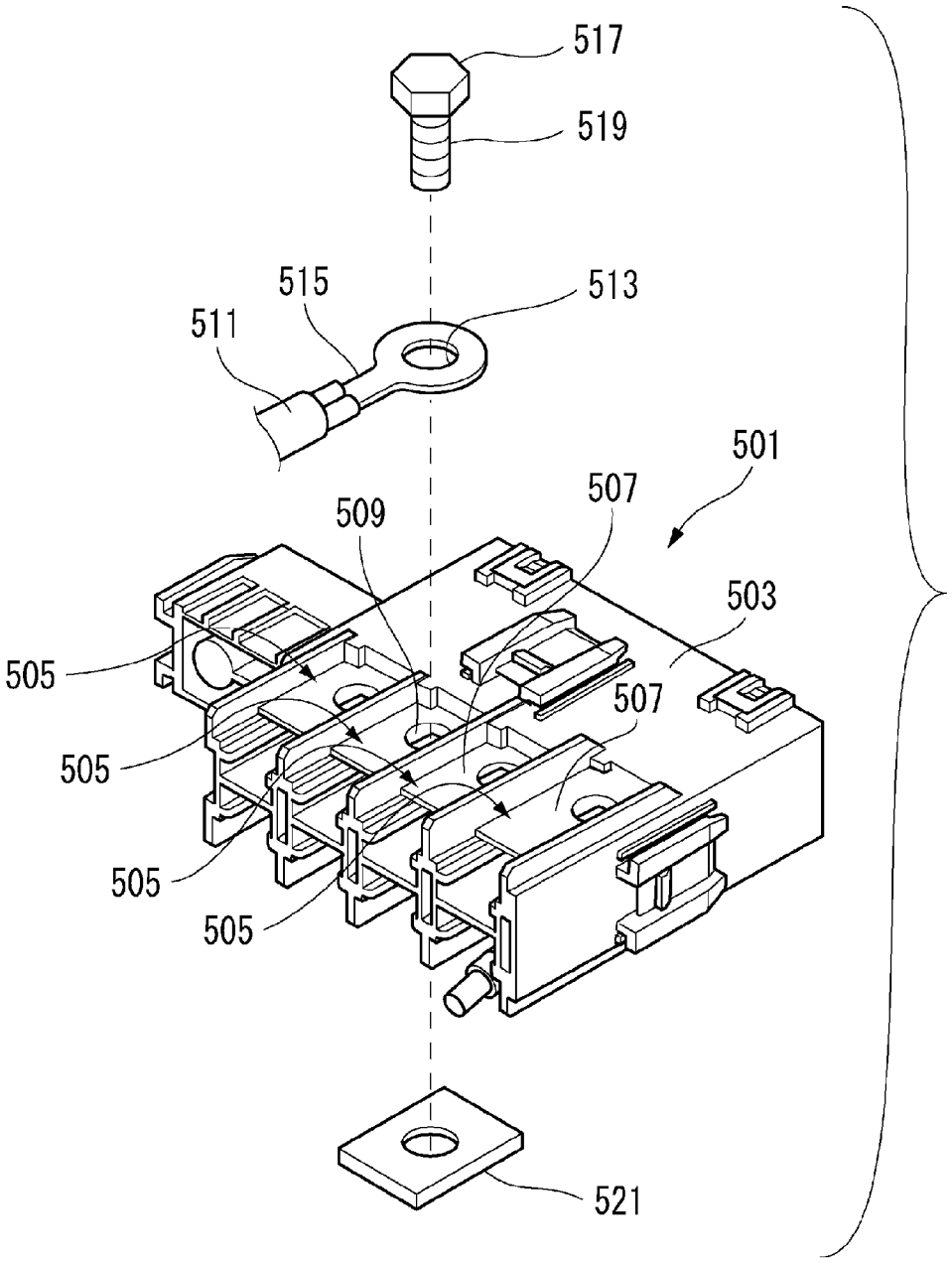
FIG. 5 is a perspective view of a current detector including a conventional terminal connecting structure.

Then, the connecting terminal 29 having the first engaging portion 45 and the second engaging portion 47 both locked and fixed to the terminal connection portion 21 is held in a state in which the electric connection plate portion 59 curved and convex toward the terminal connection portion 21 is strongly pressed on the terminal connection portion 21 due to the elastic restoring force, so that high contact load is provided on the bus bar 19. When the electric connection plate portion 59 is to be pressed against the terminal connection portion 21, the first engaging portion 45 functions as a fulcrum, the side of the conductor crimp portion 43 functions as a point of force, and, according to the principle of the lever, the pressing force is applied to the electric connection plate portion 59 functioning as a point of application. Therefore, the connecting terminal 29 is held in a state in which it is strongly pressed, by a small pressing force. As described above, according to the terminal connecting structure of the embodiment, the contact load between the bus bar 19 and the connecting terminal 29 can be increased. Therefore, the allowable current value can be set high, and compatibility can be improved. At an initial stage as shown by a phantom line of the electric connection plate portion 59 in FIG. 4, the connecting terminal 29 contacts the terminal connection portion 21 in a form of a largely inclined curve. In contrast, when the first engaging portion 45 and second engaging portion 47 are locked as shown by solid lines in FIG. 4, the electric connection plate portion 59 contacts the terminal connection portion 21 in a curved manner but with a smaller inclination. With this curved shape with a smaller inclination, the electric connection plate portion 59 retains elastic restoring force. In the terminal connecting structure of the embodiment, as described above, the contact pressure is ensured by using the shape of the electric connection plate portion 59, and the characteristics (the conductivity and the spring property) of the materials of the terminals. Therefore, the connecting terminal 29 is surely connected and fixed to the terminal connection portion 21 without using a bolt and a nut (as a result, a connection failure or the like due to a thread tightening failure does not occur, and the terminal connecting structure can be compactified).

Moreover, the connecting terminal 29 itself in which the rear end is fixed to the end portion of the electric wire has the fixing structure (the first engaging portion 45 and the second engaging portion 47), and is directly fixed to the bus bar 19 having the locking structure (the first locking portion 31 and the second locking portion 33). Therefore, additional fastening means is not required. The fixing structure and the locking structure can be formed simply by pressing the connecting terminal 29 and the bus bar 19 (as a result, the number of components can be reduced).

In the terminal connecting structure of the embodiment, furthermore, the worker holds the connecting terminal 29, locks the first engaging portion 45 by the first locking portion 31, and then presses down the portion of the connecting terminal 29 on the side of the conductor crimp portion 43, toward the terminal connection portion 21 to engage the second engaging portion 47 with the second locking portion 33, whereby the press contacting and fixation of the connecting terminal 29 to the bus bar 19 is easily completed. In the connecting terminal 29, the first engaging portion 45 and the second engaging portion 47 are reliably locked by the elastic restoring force of the curved electric connection plate portion 59, high contact load between the terminal and the bus bar 19 can be obtained, and, when the series of works is completed, a predetermined contact load is always obtained. Therefore, the operations with the conventional terminal connecting structure using the bolt 517 and the nut 521, such as aligning of the terminal hole and the bus bar hole, temporal tightening of the bolt for preventing skew tightening, full tightening of the bolt, and checking of bolt looseness, are not required. Moreover, the torque wrench for checking whether a predetermined tightening torque is obtained or not is not necessary (as a result, man-hours of the terminal connecting work can be reduced).

In the terminal connecting structure of the embodiment, moreover, the hook-shaped first engaging portion 45 of the connecting terminal 29 having a U-shaped cross section is first inserted to the back side through the slit opening 35*a* in the exposed distal end side of the terminal connection portion 21, passed through the space 27, and then projected from the back side of the bus bar 19 to the surface side of the bus bar 19 with being passed through the slit opening 35*b* in the exposed base end side of the terminal connection portion 21. Therefore, the first engaging portion 45 is reliably locked by the first locking portion 31 in the direction in which the first engaging portion does not separate from the surface of the bus bar 19, and does not move in the wire pulling direction.

Moreover, the second engaging portion 47 having the engagement opening 57 of the connecting terminal 29 is fitted onto the cut-and-raised second locking portion 33 having the hook-shaped distal end, whereby the second locking portion 33 which has been once elastically deformed is elastically restored to be locked by the upper surface 55 defining the opening edge of the engagement opening 57. The folded back distal end of the second locking portion 33 is strongly butted against the upper surface 55 defining the opening edge due to the elastic restoring force of the electric connection plate portion 59 that is being pressed, so that the locking by the engagement opening 57 is difficult to be released.

According to the terminal connecting structure of the embodiment, therefore, a connection failure is less likely to occur, and the number of components and working man-hours can be reduced. The invention is not limited to the embodiment described above, and changes and modifications may be made therein as appropriate. In addition, the materials, shapes, dimensions, values, forms, numbers, places, and the like of the components of the above-described embodiment are optional and are non-limiting insofar as the invention is achieved.

Features of the terminal connecting structure according to the embodiment of the invention described are listed in (1) and (2) below in a brief and summarized manner.

(1) A terminal connecting structure includes a terminal connection portion 21 of a metal plate (a bus bar) 19, the terminal connection portion 21 having a first locking portion 31 and a second locking portion 33, and an electric connection plate portion 59 of a connecting terminal 29, a rear end portion of which is fixed to an end portion of an electric wire, the electric connection plate portion 59 being curved and convex in a direction facing the terminal connection portion 21, the electric connection plate portion 59 having a first engaging portion 45 formed at distal end portion and locked by the first locking portion 31, and a second engaging portion 47 formed on a side where the electric wire is fixed, the second engaging portion 47 being locked by the second locking portion 33 in a state in which the electric connection plate portion 59 is pressed on the terminal connection portion 21.

(2) The terminal connecting structure having the configuration of (1) described above, in which the first locking portion 31 includes a pair of slit openings 35*a*, 35*b* provided in the terminal connection portion 21 side by side in the front-rear direction of the connecting terminal 29, the second locking portion 33 has a hook-shaped cut-and-raised projection 39 configured such that the terminal connection portion 21 is cut and raised and having a folded back distal end, the first engaging portion 45 is configured as a hook passing through the pair of slit openings 35*a*, 35*b*, and having a U-shaped cross section, and the second engaging portion 47 includes an engagement opening 57 in which the cut-and-raised projection 39 of the second locking portion 33 is inserted such that the folded back distal end is butted against the upper surface 55 of the opening edge.

The application is based on Japanese Patent Application No. 2013-003373 filed Jan. 11, 2013, the content of which is incorporated herein by reference.

INDUSTRIAL APPLICABILITY

According to the terminal connecting structure of the invention, a connection failure is less likely to occur, and the number of components and working man-hours can be reduced.

DESCRIPTION OF REFERENCE SIGNS

11 . . . current detector
19 . . . bus bar (metal plate)
21 . . . terminal connection portion
29 . . . connecting terminal
31 . . . first locking portion
33 . . . second locking portion
35*a*, 35*b* . . . slit opening
39 . . . cut-and-raised projection
45 . . . first engaging portion
47 . . . second engaging portion
55 . . . upper surface at opening edge
57 . . . engagement opening
59 . . . electric connection plate portion

The invention claimed is:

1. A terminal connecting structure comprising:

a terminal connection portion of a metal plate, the terminal connection portion comprising a first locking portion and a second locking portion; and an electric connection plate portion of a connecting terminal, a rear end portion of which is fixed to an end portion of an electric wire, the electric connection plate portion being curved and convex in a direction facing the terminal connection portion, the electric connection plate portion comprising a first engaging portion formed at a distal end portion of the electric connection plate portion and locked by the first locking portion and a second engaging portion formed on a side where the electric wire is fixed, the second engaging portion being locked by the second locking portion in a state in which the electric connection plate portion is pressed on the terminal connection portion.

2. The terminal connecting structure according to claim 1, wherein the first locking portion comprises a pair of slit openings provided in the terminal connection portion side by side in a front-rear direction of the connecting terminal, the second locking portion comprises a hook-shaped cut-and-raised projection configured such that the terminal connection portion is cut and raised and having a folded back distal end, the first engaging portion is configured as a hook passing through the pair of slit openings and having a U-shaped cross section, and the second engaging portion comprises an engagement opening in which the cut-and-raised projection of the second locking portion is inserted such that the folded back distal end is butted against an upper surface of the second engaging portion defining an opening edge.

3. The terminal connecting structure according to claim 1, wherein the terminal connection portion includes a contact surface and an opposing surface opposite to the contact surface, the electric connection plate portion includes an upper surface and a convex surface opposite to the upper surface, the convex surface engages the contact surface of the terminal connection portion, the first engaging portion of the electric connection plate portion contacts the opposing surface of the terminal connection portion and the second locking portion of the terminal connection portion engages the upper surface of the electric connection plate portion such that the electric connection plate portion elastically deforms toward the terminal connection portion.

4. The terminal connecting structure according to claim 1, wherein the second engaging portion of the electric connection plate portion is provided between, with respect to a longitudinal direction of the connecting terminal, the first engaging portion at the distal end portion of the electric connection plate portion and the rear end portion of the connecting terminal at which the end portion of the electric wire is fixed, and wherein the electric connection plate portion is curved and convex along the longitudinal direction of the connecting terminal.

* * * * *